United States Patent [19]

Rosenvold

[11] 4,047,605

[45] Sept. 13, 1977

[54] GOLF PRACTICE SWING APPARATUS

[76] Inventor: Leo Rosenvold, Wildrose, N. Dak. 58795

[21] Appl. No.: 656,805

[22] Filed: Feb. 10, 1976

Related U.S. Application Data

[63] Continuation-in-part of Ser. No. 612,328, Sept. 11, 1975, abandoned.

[51] Int. Cl.[2] ..... A63B 69/36

[52] U.S. Cl. ..... 194/1 R; 273/186 R

[58] Field of Search ..... 273/32 R, 32 B, 32 C, 273/35 R, 186 R, 186 A, 35 A; 194/1, DIG. 11

[56] References Cited

U.S. PATENT DOCUMENTS 3,604,712 9/1976 Prior et al. ..... 273/186 R

*Primary Examiner*—Stanley H. Tollberg
*Attorney, Agent, or Firm*—Robert E. Kleve

[57] ABSTRACT

The invention comprises a golf practice swing apparatus. The apparatus has a base support with a main pole extending upward at a slight angle toward the position where a golfer would normally stand. A swing arm is mounted on the main pole and pivotally mounted to rotate on an axis perpendicular to the length of the main pole and in a plane parallel to the main pole. The swing arm has a spring biased lever pivotally mounted to the lower end of the swing arm to pivot in generally the same plane as the swing arm rotates. A club head is mounted to the lower end of the lever and a club shaft is pivotally mounted to the club head and projects toward the position the golfer would normally stand. The club head lies in the general plane of the swing with its face perpendicular to the plane. The swing arm has a pivotally mounted section to allow the lever arm and club head to swing out of the plane to one side in a direction toward the golfer, but prevents the lever arm and club head from swinging out of the plane in the opposite direction toward the pole. The golfer may swing the shaft to swing the club head in a normal golf swing. With light laterally urging of the shaft toward the pole by the golfer while performing the swing, the apparatus will maintain the club head in the same plane of the swing arm throughout the swing and maintain the club face perpendicular to the line of travel while swinging the club in the normal back swing and forward swing. This gives the golfer the feel of swinging a club in the same plane and the club face perpendicular to the line of travel for an entire golf swing.

3 Claims, 17 Drawing Figures

GOLF PRACTICE SWING APPARATUS

This application is a continuation-in-part of my earlier co-pending patent application, Ser. No. 612,328, filed Sept. 11, 1975, now abandoned.

This invention relates to golf equipment.

It is an object of the invention to provide a novel golf practice swing apparatus to improve the golf swing of players of the game.

It is another object of the invention to provide a novel golf practice swing apparatus which acts to completely guide a player through a complete golf swing, and which device enables the player to practice to eliminate a slice or a hook during the guided swing.

It is another object of the invention to provide a novel golf practice swing apparatus which guides the club of a golfer as he swings the club, so as to cause the clubs to swing in a relatively perfect circle or arc. The apparatus has stop means to maintain the face of the club mechanically perpendicular to the line of travel of the club head by the operator or golfer urging the club against the stop means as the golfer swings the club so as to eliminate a hook or a slice in the swing.

It is another object of the invention to provide a novel golf practice swing apparatus which as a swingable club, which the golfer can swing in a normal standing position. This apparatus guides the club to swing in a relatively perfect circle and which mechanically enables the golfer to maintain the club perpendicular to the line of travel of the club head as he swings, so as to practice eliminating slices and hooks by swinging the club of the apparatus.

Further objects and advantages of the invention will become apparent as the description proceeds and when taken in conjunction with the accompanying drawings wherein.

Briefly stated, the invention comprises a golf practice guide swing apparatus having a stand with a pole projecting upward therefrom and inclined slightly forward toward the position of the operator of the apparatus would stand, a swing arm is pivotally mounted to the pole to pivot about an axis perpendicular to the pole and in a plane parallel to the pole, pivotal connection between the upper and lower portions of said swing arm, a lever arm pivotally mounted to the lower end of the swing arm to pivot in the plane of the swing arm, a club head fixed to the lower end of the lever arm in the plane of the swing arm and with the club face perpendicular to the mounting of the swing arm, a shaft pivotally mounted to the club and projecting upward and inclined toward the position an operator of an apparatus would stand, said operator may grasp the shaft and swing the shaft and club in its normal swing, said shaft and club being able to swing out of the plane of the swing in a direction toward the operator but not in the direction toward the pole, whereby if the operator urges the club in the direction of the pole while he swings the club, the club will lie in the same plane throughout the entire swing and the club face will remain perpendicular to the line of travel which will enable the operator to thereby practice eliminating slices and hooks from his golf swing.

Figure 2:
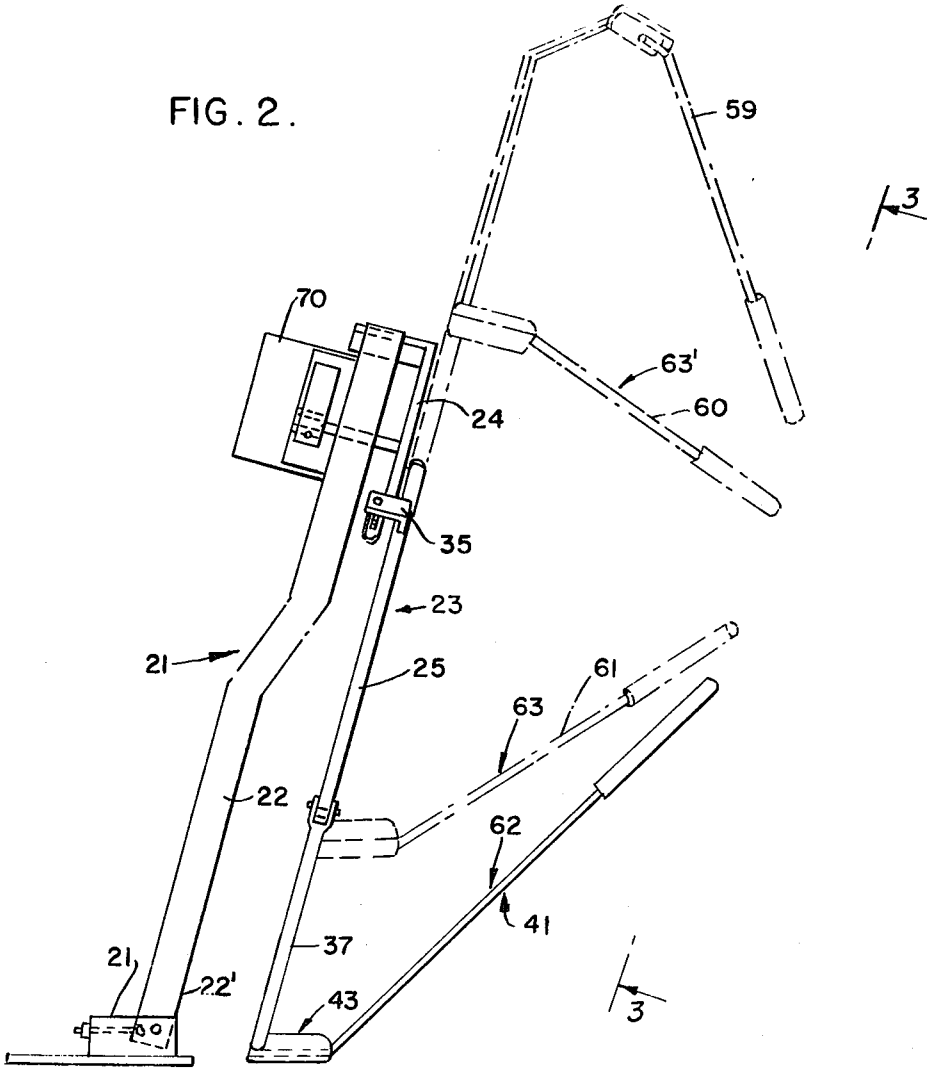
FIG. 2 is a side elevational view of the practice guide swing golf apparatus with the club head and shaft illustrated in phantom lines several positions during a golf swing.
Figure 1:
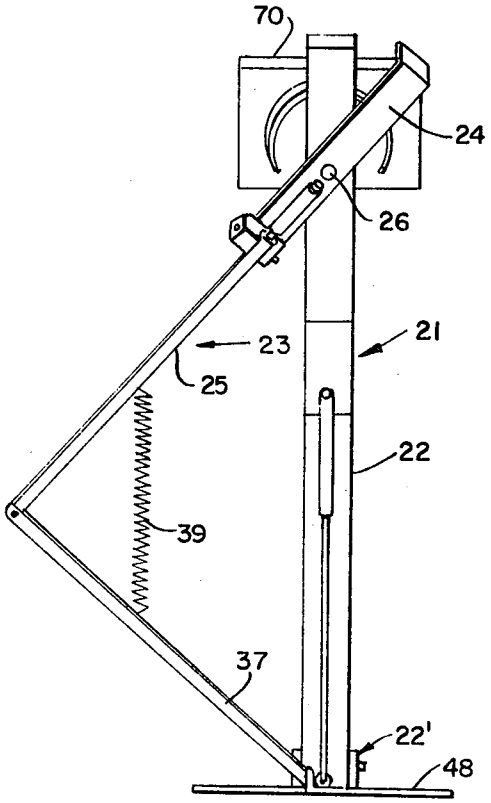
FIG. 1 is a front elevational view of the guide swing golf apparatus.
Figure 3:
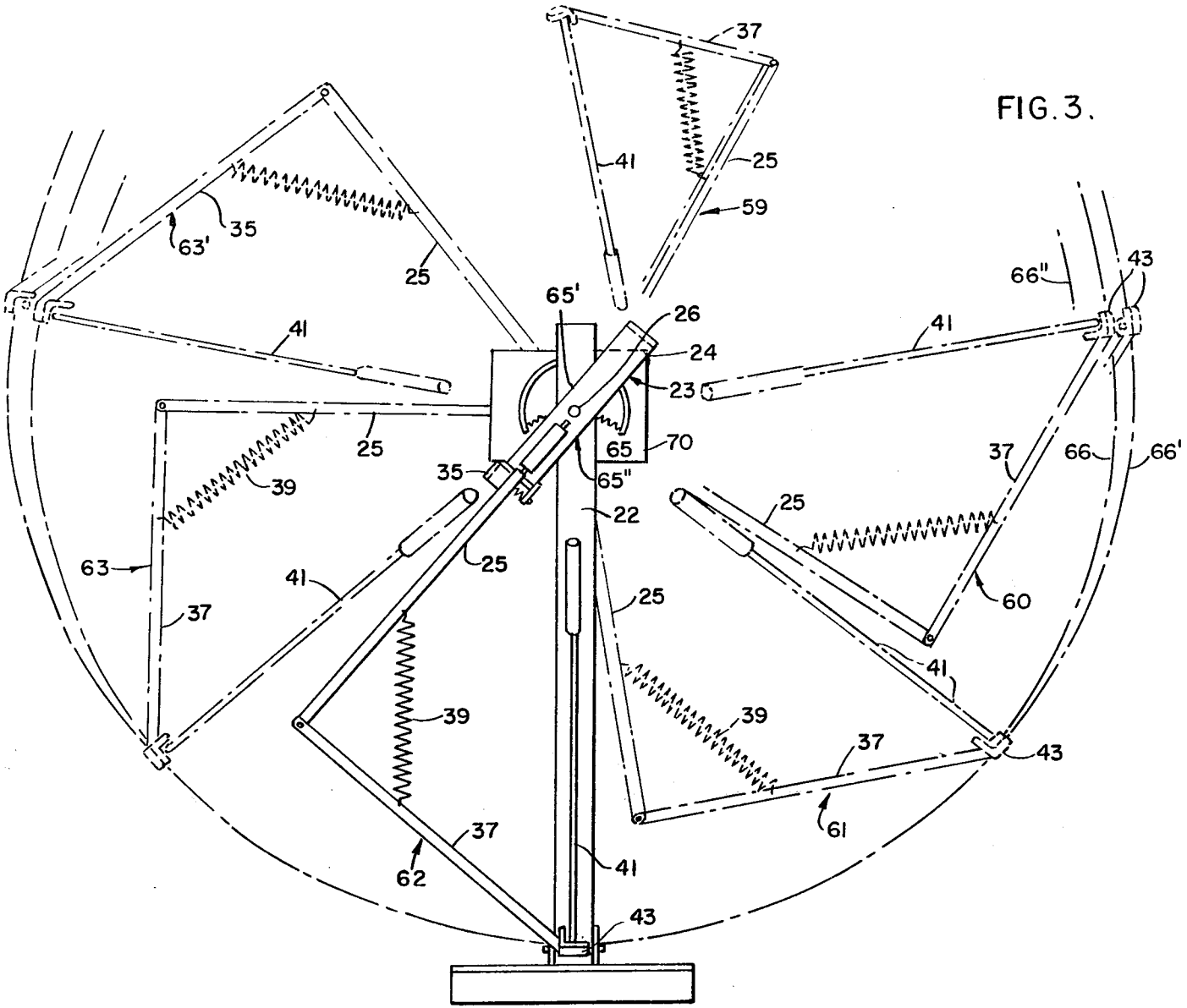
FIG. 3 is a cross-sectional view of the golf apparatus with the club head and shaft illustrated in several positions during a complete golf swing.
Figure 4:
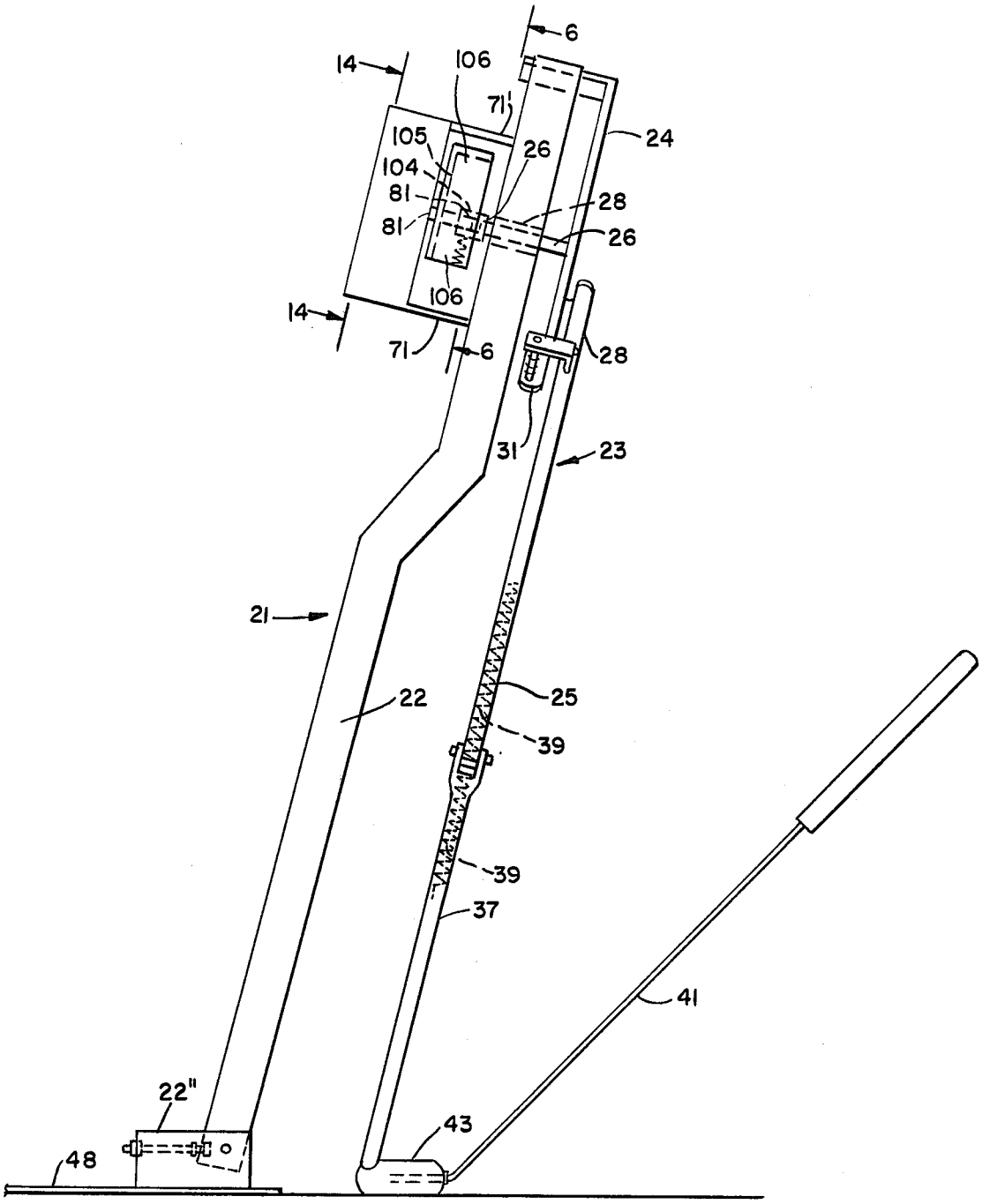
FIG. 4 is an enlarged front elevational view of the glof club apparatus.
Figure 5:
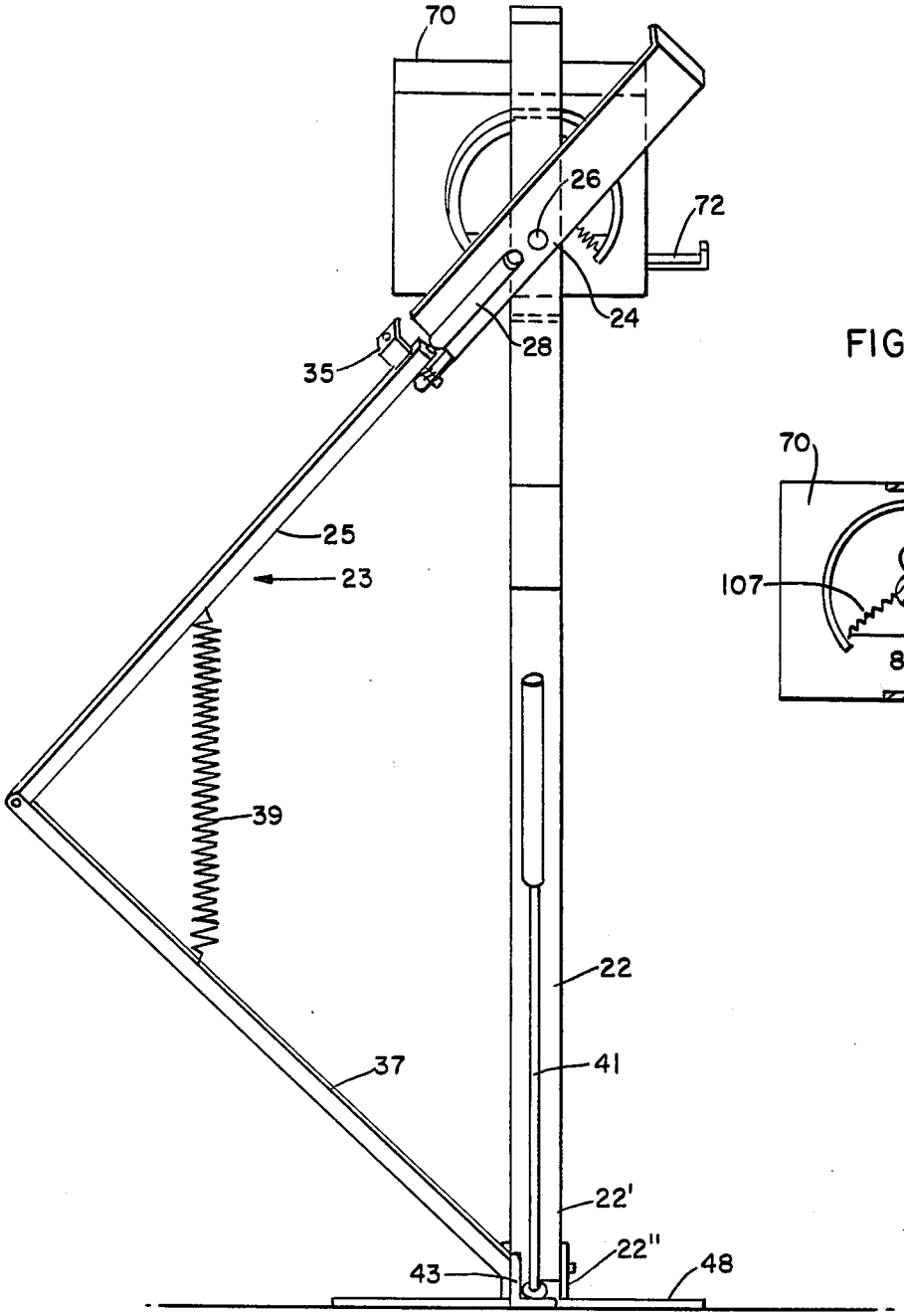
FIG. 5 is an enlarged side elevational view of the golf club apparatus.
Figure 6:
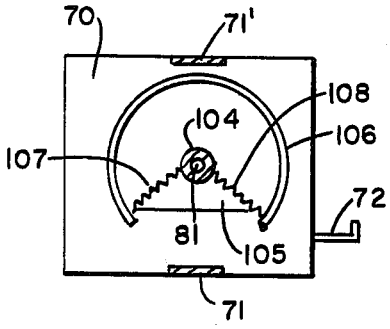
FIG. 6 is a cross-sectional view taken along line 6—6 of FIG. 5 of the cam box and cushioning mechanism.

Referring more particularly to the drawings in FIGS. 1, 2, and 3, the golf practice swing apparatus 20 has a base support member 21. A main pole 22 has its lower end 22' mounted to the base support member at an adjusted angle.

The main swing arm 23 has two parts, an L-shaped plate member 24 and an elongated rod member 25. The L-shaped plate 24 of the swing arm 23 is pivotally mounted to the upper end of the pole 22 by a shaft 26. The shaft 26 is fixed to the L-shaped plate and the main pole has a sleeve bearing 28 fixed in a bore through the pole. The shaft 26 projects through the bore of the sleeve bearing 28 and rotates in the sleeve 28. The main swing arm may pivot about the axis of the shaft 26 by the shaft 26 rotating in the sleeve 28 of the main pole 22.

The rod member 25 of the swing arm is pivotally mounted relative to the L-shaped plate 24 of the swing arm 23, by a shaft 29 which is fixed to the upper end of the rod member 25. The shaft is rotatably mounted in a sleeve 30. The sleeve 30 is fixed to the L-shaped plate 24 of the swing arm 23.

The plate 24 has a small lateral flange 31 fixed to its lower end with a hole 31' therethrough. The rod member 25 has an L-shaped plate 35 with one end fixed to the rod member 25. The other end 35' of the plate 35 has an elongated slot 36. A bolt 32 projects through the slot 36 in the plate 35 and through a coil spring 32 fitted under compression between the end 35' of plate 35 and the lateral flange 31 and the other end of the bolt 32 projects through a hole 31' in the flange 31. A nut 34 is threaded onto the other end of the bolt 32. The head of the bolt 32 is over sized in relation to the slot 36 so that the head of the bolt cannot slide through the slot 36.

A lever arm 37 is pivotally mounted to the lower end of rod member 25.

Figure 11:
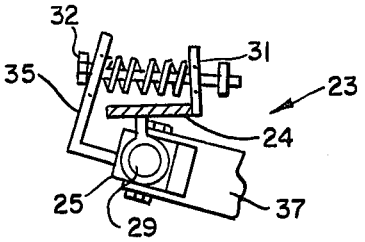
FIG. 11 is a similar cross-sectional view of the pivotal connection between the two parts of the swingable arm with the one part of the swingable arm pivoted out.
Figure 10:
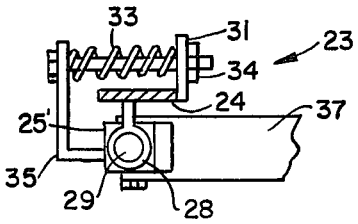
FIG. 10 is a cross-sectional view taken along line 10—10 of the FIG. 8 of the pivotal connection between the two parts of the swingable arm with the two parts parallel to one another.
Figure 12:
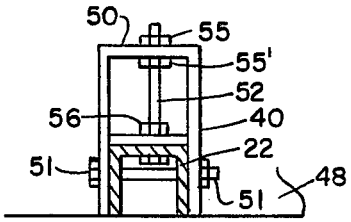
FIG. 12 is a cross-sectional view directed vertically downward taken along line 12—12 of FIG. 1 illustrating the construction of the base support and construction of the pole.
Figure 9:
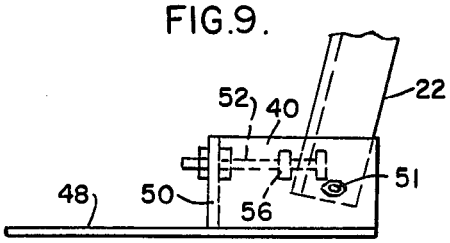
FIG. 9 is a fragmentary side view of the base support or stand and the club head.
Figure 13:
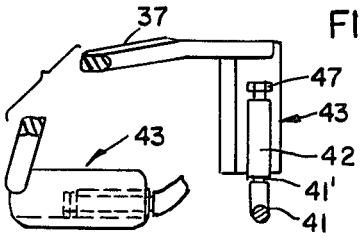
FIG. 13 is a cross-sectional view directed vertically downward when along line 13—13 of FIG. 1 illustrating the construction of the club head and connecting portion of the lower lever arm.
Figure 16:
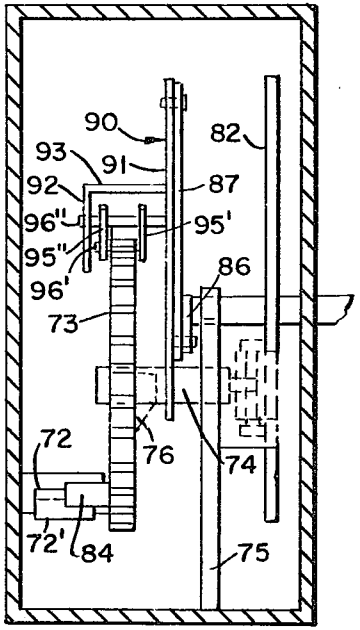
FIG. 16 is a cross-sectional view of the cam box mechanism taken along line 16—16 of FIG. 14.

The rod member 25 and lever 37 can pivot from their position in which they both lie in plane 58, as shown in FIG. 11, to a position so that lever 37 lies outside of at a slight angle to plane 58, as shown in FIG. 12.

The spring 33 is under compression and continually urges the L-shaped plate, and thereby continues to urge the rod member 25 and lever 37 back to their position shown in FIG. 11, so that the rod member 25 and lever arm 37 both rest in plane 58 and parallel to plane 58.

Figure 7:
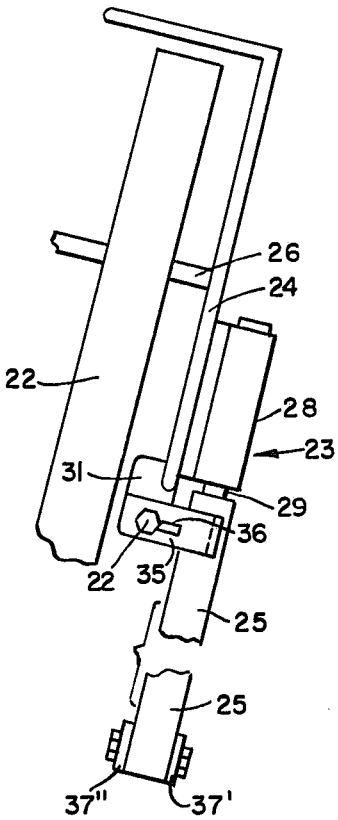
FIG. 7 is an enlarged side fragmentary view of the pole, swingable arm, and illustrating the pivotal connection of the swingable arm with the pole, and the pivotal connection between the two parts of the swingable arm, with the swingable arm parallel to the pole.
Figure 8:
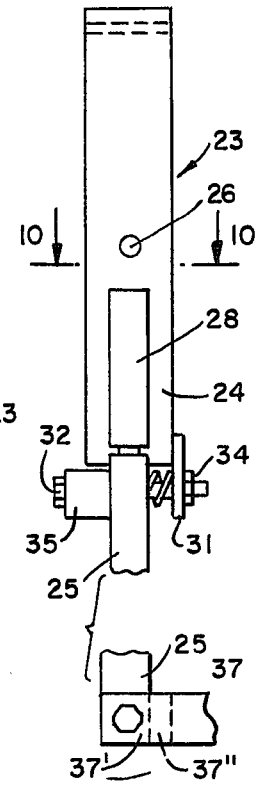
FIG. 8 is an enlarged front fragmentary view of the same structure shown and as positioned in FIG. 7.

If the lever arm 37 is pivoted counterclockwise, when viewed from FIG. 7, from its position shown in FIG. 7 to its position shown in FIG. 8, the bolt 32 by engaging the end 36' of the slot 36, limits or stops the axial movement of the bolt 32 and thereby stops the rod 25 and lever 37 when they reach their position in FIG. 8 to prevent the rod member and lever arm from pivoting counterclockwise past their position shown in FIG. 8. This prevents the lever arm from moving counterclockwise past its parallel position in plane 58, as shown in FIG. 8.

A lever arm 37 has its one end pivotally mounted to the lower end 25' of the rod member 25. The lever arm 37 has a pair of flanges 37' and 37'' fixed to its one end and a bolt 38 passes through the bores in flanges 37' and 37'' and through a bore in rod member 37 to pivotally connect the lever arm 37 to the rod member 25, so that the lever arm 37 can pivot relative to the rod member 25 about the axis of bolt 38. The lever arm 37 can pivot a substantial distance in either direction relative to the rod member 25. A spring 39 has one end attached to the rod member 25 and its other end attached to the lever arm 37 to urge the lever arm counterclockwise toward the rod member about the bolt 38 when viewed from FIG. 1.

A golf club 40 has a shaft member 41. The lower end 41' of the shaft member 41 has a lateral bend. The lateral portion is cylindrical and is rotatably mounted in a cylindrical bore of a cylindrical sleeve 42. The club has an L-shaped plate 43 with the sleeve 42 welded to one flange 44 of the plate 43. The other face 45 of the L-shaped plate 43 forms the simulated face of the head of a golf club which face would normally strike the golf ball.

The lower end 46 of the lever arm 37 is welded to the front upper edge of the L-shaped plate 43, forming the head of the club 40.

A bolt 47 is threaded into the end of the lateral portion 41' of the shaft of the club with the head 47' of the bolt oversized in relation to the sleeve 42 to retain the lateral portion of the shaft in the sleeve. The shaft 41 of the club is free to pivot relative to the L-shaped head 43 about the longtudinal axis of the lateral portion 41' of the shaft 41.

The base support 21 has a broad metal base plate 48 and a pair of parallel metal upright flanges 49 and 49' are welded in the base plate 48. A front metal upright plate 50 is welded across the ends of the flanges 49 and 49' and welded to the base plate 49. The pole 22 is pivotally mounted to the upright flange 49 and 49' by a bolt 51. Bolt 51 passes through bores in the flanges 49 and 49' and through a bore in the pole 22 to pivotally mount the pole 22 to the base support, so that the pole 22 may be pivoted to different angles about the axis of the bolt 51.

A second bolt 52 passes through a bore 53 in the pole 22 and through a bore 54 in the front flange 50. A pair of nuts 55 and 55' are threaded onto the bolt 52 on opposite sides of the flange 50 to lock the pole 22 in its adjusted angular position shown in FIG. 2.

A third nut 56 is threaded on the bolt 52 against the outside of the pole 22 to maintain the pole 22 firmly in its adjusted position.

The pole 22 is adjusted to a slightly forward angle from vertical, as shown in FIG. 2, so that when a person swings the club of the apparatus while standing in front of the apparatus at the position shown generally by numeral 57, the angle of the rotation of the club head 43 through an arc, by the rotation of the swing arm, lever arm and club head about the shaft 27, will generally conform to the angled arc of travel of the normal golf swing of a golfer when the golfer swings the club from in front of the apparatus.

The pole 22 can be adjusted to different angles by threading the nuts 55 and 55' forward or threading the nuts 55 and 55' rearward on the bolt 52 to thereby pivot the pole 22 either forward or rearward about the bolt 51 of the base support to change the angle of the pole.

The plate 48 of the base support will be firmly bolted to a metal floor or bolted to a relatively heavy wooden platform. This floor or platform will have sufficient weight to maintain the base support in its position shown, under the weight of the pole 21, and the other components of the golf swing apparatus.

The floor or platform will have a length and width enough so that the golfer may also stand on it in front of the apparatus while operating the apparatus.

OPERATION

The golfer will operate the apparatus as follows:

The golfer will stand in front of the apparatus at the position generally shown by numeral 57 and face the apparatus and grasp the shaft 41 of the club with the normal grasp with the club in its position shown in FIG. 1.

The golfer will then begin the back swing by swinging the club shaft counterclockwise when viewed from FIGS. 1 and 3, and at the same time the spring 33 acts to keep the club head 43 in plane 58 although it may be necessary to further urge the club shaft laterally toward the apparatus to urge the club head laterally toward the apparatus, so that the nut 34 of the bolt is against the end of the stop flange 31 as he swings the club backward and upward. The urging of the shaft toward the apparatus pivots the lever arm 37 and club head into plane 58, so that when the lever arm and club head reach plane 58 the nut 34 engages the flange 31.

The continuously laterally urging of the shaft keeps the bolt against the flange thereby keeping the club head in the plane 58 and perpendicular to the line of travel throughout the back swing until the club reaches generally the position 59.

The golfer can pull the club head out of the plane 58 to the right only when viewed from FIG. 2, when, for example, the golfer reaches the top of this back swing position 59 by overcoming the action of the spring. Position 59 shows the club pulled a little out of plane 58.

The pivotal connection between plate 24 and rod 25 of the swing arm enables the club to be pulled out of alignment.

The golfer can feel the spring action and recognize that the club is a little out of alignment and positively urge the club laterally toward the apparatus until the nut engages the flange and can also feel the stop engagement and know the club is back in the plane 58 as he begins the down stroke or forward stroke.

The golfer will begin the forward swing to strike the ball by urging the club head laterally toward the apparatus until the nut engages the end of the slot to keep the club in the plane 58, while at the same time, he will begin to swing the club head by means of the shaft clockwise in a forward swing, when viewed from FIGS. 1 and 3, moving the club from position 59 to and through positions 60, 61, 62, 63, and 63' in succession for a complete forward golf swing. The golfer will normally swing the club at a slower pace than an actual golf swing.

Due to the operator urging the club laterally toward the apparatus in addition to the action of the spring, the club will be in the plane 58 with relatively easy effort and the club face thereby perpendicular to the line of travel by the time the club reaches position 60 from position 59, and the club will remain in the plane 58 and the face of the club will remain perpendicular to the line of travel while the golfer continues to swing the club through positions 60, 61, 62, 63, and 63' with light lateral urging while swinging through these positions.

As the club is swung from positions 60 on through 61, 62, 63, and 63', thus urging action on the part of the golfer which will simply consist of slightly pushing the club laterally toward the pole 22 as the club is swung in the plane 58 parallel to the pole 22. This lateral urging will keep the club face perpendicular to the line of travel of the club and keep the club in the plane 58. The stop mechanism of the bolt prevents the operator from urging the club too far laterally toward the pole as the stop action positively stops or prevents the club from moving to the left of plane 58, when viewed from FIG. 2. Consequently, the club face must remain perpendicular to the line of travel and remain in plane 58 during the forward swing through positions 60, 61, 62, 63, and 63' under normal slight lateral urging of the golfer.

The fact that the club face does remain perpendicular to the line of travel through the entire golf swing gives the golfer the feel of the proper aligning of the golf club face, so that after repeated practice swings with the practice swing apparatus, the golfer will be better able to maintain the head of the club in perpendicular alignment to the line of travel of the club in a golf swing when actually golfing.

The pole 22, swing arm 23, including plates 24 and 25, and the lever arm will be made of fairly heavy strength steel to have sufficient strength so that the swing arm, lever arm, and club head will stay in plane 58 and will withstand strong forces and will not flex out to the left of the plane during the golf swing should the golfer urge the club head laterally toward the apparatus with somewhat too strong a force.

As the club is swung through positions 60, 61, 62, 63, and 63', the club head is maintained continuously in the plane 58, so that the golfer also has the feel of a proper arc of travel of a club and shaft as he swings the club with the shaft.

This is particularly true as the club reaches positions 61, 62, 63, and 63' at the end of the swing or follow through whenever the inexperienced golfer has a tendency to pull or push the club off to one side or the other of plane 58 which creates such things as hooks or slices.

However, since the golfer can feel when the club is urged against the stop mechanism as he swings through positions 60, 61, 62, 63, and 63', if the golfer has a tendency to pull his club off to the right of plane 58 as he reaches the end of the stroke (positions 61, 62, 63, and 63'), he can feel he is fighting the spring action and that the nut is not against the flange, he can correct it to keep the club in the plane 58.

The face that the club is kept in the proper plane throughtout the entire golf swing causes or forces the golfer to use his arm and leg muscles properly and in the proper sequence and thereby trains them properly for the time when he is actually golfing.

The device has been described thusfar assuming that the golfer would have a height and arm lenth so that his golf swing would have the general radius 64, with the center axis of his swing generally at location 65, and with the arc of his swing being along arc 66, when viewed from FIG. 3.

However, golfers of different heights and arm lengths will have large or small arcs, depending upon their height and arm lengths. The pivotal connection between arms 37 and 25 and the spring return enables golfers of different heights and arm lengths to use the apparatus.

For example, a golfer taller than one whose center axis of this swing would be generally at location 65 might have the center axis of this swing at some vertical point above 65, such as location 65', with the radius of his swing being the radius 64' and the arc of his swing being arc 66'.

Also, a golfer, shorter than one whose center axis of his swing would be generally at location 65, might have the center axis of his swing at some vertical point below 65, such as location 65" with the radius of his swing being the radius 64" and with the arc of his swing being arc 66".

The golfer in actual operation will stand in front of the shaft of the club and grasp the shaft at a location suitable for his height and for his normal golf swing. Then when he swings the club clockwise or counterclockwise from its position shown in FIG. 1, the club head will follow the smaller arc or larger arc, such as arcs 66' and 66", respectively, depending upon his arm length and height. The golfer will of course keep his arms as stiff as he would in a normal golf swing to keep the proper arc for his normal swing.

However, the arc of travel of the golf head will spread out at either side of the golf head when it is directly in front of the apparatus depending upon the height of the golfer, as illustrated in FIG. 3. As the golf club head passes the point where the club head would normally strike the ball (as shown in solid lines in FIG. 1) the location of the club head will always be the same in relation to the floor, as shown, regardless of the differences in heights of the golfers using the apparatus, assuming that each golfer maintains the arc somewhat stiff armed during the swing and sets the position of his hands on the club while the club in directly in front of the apparatus, as shown in solid lines in FIG. 3.

While spring 39 will continually urge the arm 37 upward toward the swing arm, it will require a relatively modest amount of stiff arming on the part of the golfer during his swing to overcome the action of the spring to maintain the club head in the proper arc with the proper center axis for his height and his normal swing.

While the apparatus will not accommodate extremely tall persons or extremely short person, it will accommodate persons in a relatively wide range of heights.

This will also be seen that a novel practice swing apparatus has been provided which will automatically maintain the club head perpendicular to the line of travel of the club, and will automatically maintain the club head in the same plane through the same plane throughout the complete golf swing and in a proper plane for a normal golf swing with little effort on the part of the golfer and that the apparatus is adjustable for golfers of different heights.

By repeated swings of the club by the operator or golfer simply keeping swinging the club by its shaft, and being easily able to keep the club in the same and proper plane and the club face perpendicular to the line of travel, the golfer will be better trained for actually playing golf.

Although the pivotal connection between plate 24 and member 25 is provided, it is possible that it be made rigid so that the club head could not swing out of either side of plane 58.

Also, while the golf shaft is pivotally mounted to the club head, a rigid connection between the club head and the shaft could be provided if desired.

An adjustment could also be provided between the club head and the shaft, when viewed from FIG. 2, so that the shaft could be adjusted to different angles, about an axis where the club meets the shaft.

COIN OPERATED BOX MECHANISM

A rectangular metal box 70 is mounted behind the upright pole 22 by a pair of flanges 71 and 71' fixed between the box and the pole. The rectangular box 70 has a conventional slidably mounted coin operated plate 72, which receives a coin to actuate the mechanism within the box so that a golfer may swing the club 41 through 25 complete practice swings, including the back swing, the forward and power swing, and the return swing to return the club back to its rest position shown in FIGS. 1 and 2.

The one complete swing, referred to, consists of a back swing swinging the club back counterclockwise from its rest position shown in FIG. 1 to its raised position shown in FIGS. 2 and 3, and designated as position 59; then the power swing which is swinging the club cockwise from its position 59 (when viewed from FIG. 3) clockwise through positions 60, 61, 62, and 63 to its raised position 64, and the rest swinging the club counterclockwise from its raised position back to its rest position shown in solid lines in FIGS. 1 and 3.

The gear box or metal box has a main gear 73 which is rotatably mounted on a shaft 74 which shaft 74 is fixed to an upright plate 75. The upright plate 75 is fixed to the bottom of the box. The gear 73 has 28 teeth with 28 notches therebetween about its periphery. The gear 73 moves counterclockwise, when viewed from FIG. 14, ahead one notch for each complete practice swing just described. The gear 73 has a cam 76 fixed to its inside surface which is timed to engage and actuate a locking mechanism 77 to lock the club 41 upon the completion of the last stroke position of the 25th practice swing to prevent the club from being swing any further.

The gear 73 will move counterclockwise forward one tooth or one notch for each complete practice swing until the gear has been moved forward 25 notches. The locking mechanism is timed so that at the very end of the completion of the power swing of the 25th complete practice swing, the cam 76 on the rear side of gear 73, will push the shaft 78 to the right when viewed from FIG. 15 which pivots the plate 79 clockwise when viewed from FIG. 14 to its position shown in solid lines in FIGS. 14, 15, 16, and 17. The plate 79 has a pair of cam edges 80 and 80'. The shaft 81 has a plate 82 fixed thereto to swing with the shaft 81. The shaft 81, through a spring cushioning mechanism 82, is connected to shaft 26 and shaft 26 is fixed to the swing arm 23 which swing arm is connected to the club 41 so that as the club 41 is swung about the axis of shaft 26, it also rotates shaft 26, which rotates shaft 81 which rotates plate 82.

Figure 15:
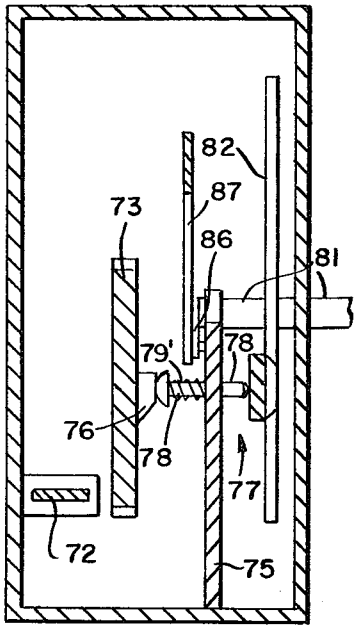
FIG. 15 is a cross-sectional view of the cam box taken along line 15—15 of FIG. 14.
Figure 14:
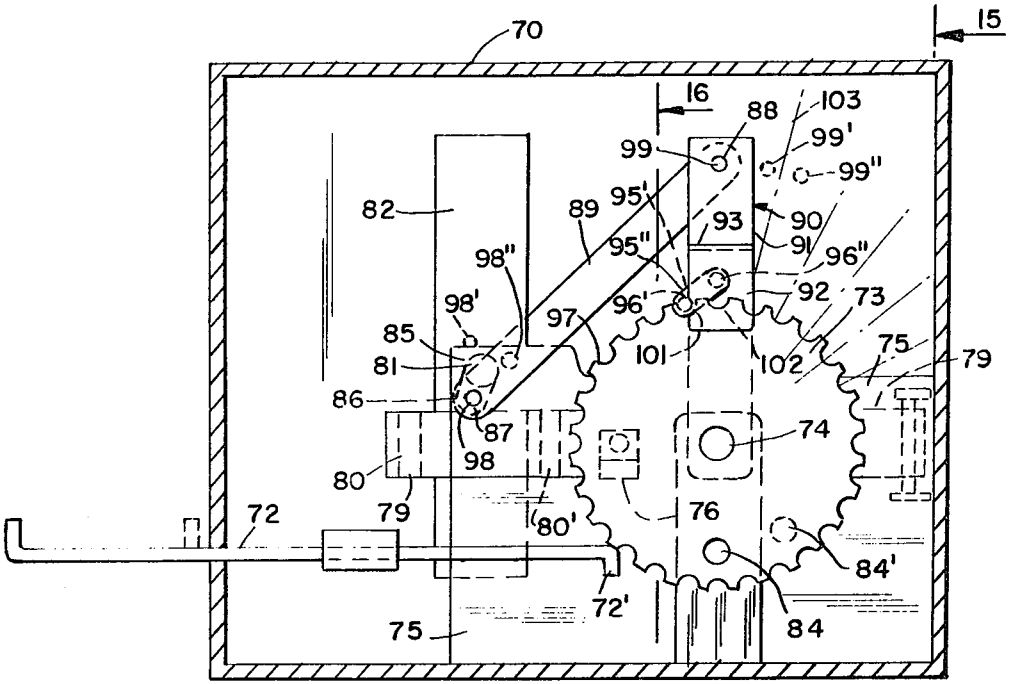
FIG. 14 is an enlarged view of the cam box taken along line 14—14 of FIG. 4.
Figure 17:
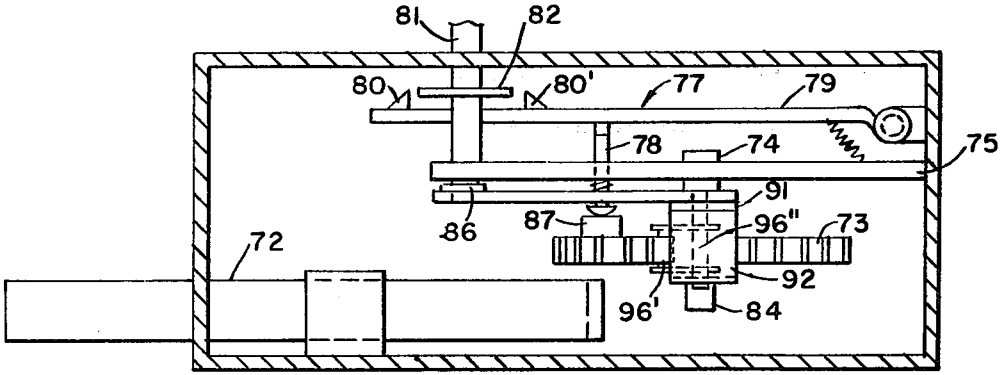
FIG. 17 is a cutaway top view of the coin operated mechanism.

Thus, at the very end of the completion of the power swing position of the 25th complete practice swing the gear 73 will, through its cam 76, push the shaft 78 to the right, pivoting the plate 79, when viewed from FIG. 14 to its position shown in solid lines in FIG. 14, as described, just as the club 41 is swung back to its rest position from position 64, which club movement pivots the plate 82 to clockwise down to its position shown in solid lines in FIG. 15 and as the plate 82 engages or slides the cam edge 80' it will flex the plate inwardly sufficiently so that the plate can pivot into its vertical position between the cam edge 80 and 80', thereby locking the plate 82 between the cam edge 80 and 80', as illustrated in FIG. 15, thereby locking the club 41 from further swinging movement. FIG. 15 illustrates the mechanism in its locked position.

When the club is swinging back to its rest position from position 64, the caming is timed to push the plate 79 just before the plate 82 reaches its vertical position as the club swings back to its rest position so as to enable the plate 79 to lock the plate 82.

Also the cam is timed to push the plate 79 forward for locking well after the club has completed the power swing of the 25th complete practice swing, so as to not interfere with the power swing.

If another coin is inserted into the coin operated plate 72, and the plate 72 is slid from left to right from its position shown in solid lines in FIG. 14 to its position shown in dashed lines in FIG. 14. The flange 72' at the forward end of the plate 72 will engage a pin 84 which pin is fixed to gear 73. The engagement of the flange 72' with the pin 84 as the plate 72 is slid to the right rotates the gear 73 ahead three notches to place the pin in its position 84'. This rotation of the gear ahead three notches causes the cam to rotate counterclockwise ahead from its position shown in solid lines in FIGS. 14 and 16 which moves the cam 65 off of the shaft 78 releasing the shaft 78. The shaft has a spring 79' which returns the pin back to its original position backing it away from plate 79, releasing plate 79. The plate 79 has a spring which pivots the plate 79 counterclockwise when viewed from FIG. 14, away from plate 82, freeing plate 82 from the cam edges of plate 79, as the plate pivots away sufficiently to be out of the path of plate 82.

This frees the club 41 so that the club may be swung through another twenty complete practice swings with the gear 73 moving ahead one notch for each complete practice swing until at the end of the 25 complete practice swings the cam will reengage the shaft pivoting plate 79 forward again to its locked position causing the plate 82 to be relocked thereby locking the club 41 again for further practice swings. When another coin is inserted into the coin operated plate 72 and the plate is pushed forward to push the gear 73 forward three notches, this again frees the club 41 so that the club 41 may be swung for another 25 complete practice swings.

Each time the coin operated plate 72 has been pushed forward pushing the gear 73 forward three notches, the coin plate 72 will be immediately slid back to its original position shown in solid lines in FIG. 15. A conventional spring return may be provided to return the plate to its original position.

The notch advancing mechanism is operated by the shaft 81. The shaft 81 has a slant lever arm 86 fixed thereto. A connecting arm 87 has its one end pivotally mounted to arm 86 at pivot point 87 and its other end pivotally mounted at pivot point 88 to a notch advancing mechanism 90.

The notch advancing mechanism 90 has a main plate portion 91 which is pivotally mounted about the shaft 74 coaxially with gear 73. The main plate portion 91 has a parallel side plate portion 92 fixed thereto by a lateral flange 93. A single section of link chain 94 has a pair of side paltes 95' and 95" with a pair of pins 96' and 96" mounted in the side plates. One of the pins 96" is also rotatably mounted between the main plate portion 91 and the parallel side plate 92, so that the side plate 95' and 95" may pivot up and down about the pin 96" with the pin 96' pivoting up and down with the side plates. Because of the angle of engagement of the pin 96' with the notches in the gear 73 when the plate 91 of the notch advancing mechanism is pivoted counterclockwise when viewed from FIG. 14, the pin 96' will not slide out of the notch but will abut the trailing edge 97 of the tooth of the gear 73 and will pivot the gear 73 counterclockwise together with the pin 96' and with the plate 91.

However, if the plate 91 is pivoted clockwise when viewed from FIG. 15, the pin 96' will, because of its relative position with respect to the tooth to the right of pin 96', slide out of the notches and slide over the tops of the teeth of gear 73. Thus the pin 96' will not move the gear 73 clockwise.

Thus the movement of the plate 91 counterclockwise from its position shown in solid lines will through the pin 96' engage with the adjacent teeth rotate the gear 73 counterclockwise. However as the movement of the plate 71 clockwise will not move the gear 73.

A conventional frictional drag will be placed on the gear 73 so that it dows rotate readily in either direction. However the counterclockwise movement of the plate 91 and the resulting counterclockwise movement of the pin 96' will have sufficient force to overcome this frictional drag and move the gear 73 with the plate when moving clockwise. But, the drag will be sufficient to prevent any accidental clockwise movement of the gear.

The notch advancing mechanism plate 91 and 92 are timed with the swing action of the club 41.

As a result, when the operator swings the club 41 backward (back swing) from its rest position to its raised position 59, the club through the swing arm 23 will rotate shafts 81 and 26, which pivots lever arm 86 clockwise when viewed from FIG. 14, from its position shown in solid lines to move its pivot point 87 from its position 98 to its position 98' and the connecting plate 87 will pivot the notch advancing plate 91 from its position shown in solid lines to move its pivot point 88 from its position 99 to its position 99'.

This causes the pin 96 to slide clockwise out of the notches 101 and up on top of the tooth between notch 101 and 102, but will not cause the pin 96' to slide far enough to slide into notch 102, since, the plate 91 moves clockwise to place the pivot at line 103 before the pin 96' can slide into notch 102.

As a consequence, the pin 96' never reaches the notch 102 during the back stroke. As a result when the back swing or back stroke is complete the pin 96' will be resting on top of the tooth between notches 101 and 102.

When the operator begins the forward stroke or power stroke moving the club 41 from position 59 through positions 60, 61, 62, 63, and 64, the shaft 81 will rotate counterclockwise (when viewed from FIG. 14) thereby pivoting lever arm 86 to counterclockwise from position 98' back to position 98. The connecting link 89 moves the plates 91 and 92 counterclockwise forward from its position 99' back to 99. This merely causes the pin 96' to slide off the tooth and back into notch 101.

However, as the power stroke continues on past position 62 toward position 64, lever arm 86 moves pivot point 82 past position 98 onto position 98", which moves the notch advancing mechanism 91 and 92 again back clockwise moveing pivot point from position 99 past position 99' to position 99" which is past line 103, thus allowing the pin 96 to slide out of notch 101 and over the top of the tooth therebetween and completely into notch 102, and start sliding a little clockwise beyond.

Now when the operator begins the rest swing from position 59 back to position 63, the shaft 81 rotates counterclockwise, when viewed from FIG. 14, moving the pivot point from position 98" back to position 98 and moving the notch advancing mechanism plates 91 and 92 counterclockwise forward from moving the pivot point 88 from position 99" past line 103 and past position 99' to position 99 with the pin 96' sliding from its position slightly to the right or beyond notch 102 counterclockwise back into the notch 102 and the pin 96 engages the trailing edge 97 of the tooth while in notch 102 and pushes the gear 73 forward counterclockwise until the notch 102 takes the position of notch 101.

Thus, when the one complete practice swing is completed the gear will have moved forward on notch.

This process repeats itself for each complete practice swing until 25 complete practice swings have been completed at which time the shaft is locked from further movement by the cam locking action preventing any further practice swings of the club 41.

Cushioning connection between shaft 81 and shaft 26 is provided so that the club 41 will not abruptly come to a stop when the club is swinging sharply to its limit in either direction.

The shaft 26 has a sleeve portion 104 fixed thereto which sleeve portion is slidably mounted to rotate on shaft 81. The shaft 81 has also a plate 105 fixed thereto and a cylindrical partial wall 106 fixed to the plate with springs 107 and 108 hooked at their one ends to the cylindrical partial wall and extending downward and attached to the sleeve 104 of the shaft 26 at their other end so that the club 41 and shaft 26 may pivot relative to shaft 81 in either direction in the event that the shaft 81 comes to a sudden stop, by the springs drawing or expanding by the movement of the sleeve relative to the springs, wall, and plate of shaft 81 with the springs pushing shaft 26 back to the normal position relative to shaft 81 once the sudden stop action has been absorbed by the springs.

Thus, it will be seen that a novel cam mechanism has been provided for cam operating the practice swing apparatus and that a novel practice swing apparatus has been provided.

The subject matter being added by this combination-in-part is the coin operated box mechanism and a revision in the operation of the spring actuated pivotal connection between flange 24 and rod 25.

It will be obvious that various changes and departures may be made to the invention without departing from the spirit and scope thereof and accordingly it is not intended that the invention be limited to that specifically described in the specification or as illustrated in the drawing but only as set forth in the appended claims wherein.

What is claimed is:

1. A golf practice swing device comprising a base support with an inclined main post extending in length upward at an acute angle from vertical and toward a position wherein a golfer operator may stand to operate said device, a first arm pivotally mounted at its upper one end to said main post to rotate on an axis perpendicular to the length of the main post to rotatably move in a plane parallel to the main post with said axis extending downwardly from said post at an angle toward the position where a golf operator may stand, a second arm pivotally mounted at its one end to the lower end of the first arm to pivot generally parallel to the same plane as the first arm pivotally rotates in, a club head fixed to the other end of the second arm, said club head having a striking face fixed laterally and perpendicularly to the plane of movement of the first arm and second arm, a club shaft having its one end attached to the club head with its other end providing a handle for the golfer to grasp, said one end of said club shaft attached to said club head so that the club shaft may extend from the club head laterally to the plane of movement of the first arm and second arm upward toward the position where the golfer operator may stand with the handle at the upper end, whereby the golfer operator may grasp the handle of the club shaft and swing the club shaft to thereby swing the club shaft and club head in a manner of a normal golfer swing with the fixed connection between the club head and second arm and the pivotal connection between the first and second arm causing the club head to follow the second arm and first arm to pivot about the axis of the first arm to stay in a plane parallel to the plane of the first arm and second arm, and causing the club face to stay perpendicular to the line of travel of the first arm and second arm throughout the club swing, with the club head guided by the first arm and second arm in a path as would prevent slices or hooks to thereby give the golfer operator the feel of swinging the golf club with the club head in said path, and with the pivotal connection between the second arm and first arm adjusting the head of the club to the radius of the arc of the golfer operator during the course of the swing.

2. A golf practice swing device comprising a base support with support means extending upward and with the upper end of support means extending from said base support forward toward a position wherein the golfer operator may stand to operate said device, a first arm pivotally mounted at its upper one end to said main post to rotate on an axis perpendicular to the length of the main post to rotatably move in a plane parallel to the main post with said axis extending downwardly from said post at an angle toward the position where a golf operator may stand, a second arm pivotally mounted at its one end to the lower end of the first arm to pivot generally parallel to the same plane as the first arm pivotally rotates in, a club head fixed to the other end of the second arm, said club head having a striking face fixed laterally and perpendicularly to the plane of movement of the first arm and second arm, a club shaft having its one end attached to the club head with its other end providing a handle for the golfer to grasp, said one end of said club shaft attached to said club head so that the club shaft may extend from the club head laterally to the plane of movement of the first arm and second arm upward toward the position where the golfer operator may stand with the handle at the upper end, whereby the golfer operator may grasp the handle of the club shaft and swing the club shaft to thereby swing the club shaft and club head in a manner of a normal golfer swing with the fixed connection between the club head and second arm and the pivotal connection between the first and second arm causing the club head to follow the second arm and first arm to pivot about the axis of the first arm to stay in a plane parallel to the plane of the first arm and second arm, and causing the club face to stay perpendicular to the line of travel of the first arm and second arm throughout the club swing, with the club head guided by the first arm and second arm in a path as would prevent slices or hooks to thereby give the golfer operator the feel of swinging the golf club with the club head in said path, and with the pivotal connection between the second arm and first arm so that adjustment may be made to the head of the club to the radius of the arc of the golfer operator during the course of the swing.

3. A golf practice swing apparatus according to claim 2 wherein a coin operated mechanism box is mounted to said apparatus behind said swing arm, said box having a tooth gear rotatably mounted in said box, said gear having a plurality of teeth about its circumference with notches therebetween, a tooth advancing mechanism connected to said swing arm to advance said gear a definite amount of at least one notch, in response to said swing arm pivoting following said club through a complete practice swing means locking said gear and said swing arm after said gear has rotated ahead a predetermined number of notches, cam means unlocking said gear and swing arm upon insertion of a coin whereby said operation may repeat itself.

* * * * *